US008019247B2

(12) United States Patent
Mito et al.

(10) Patent No.: US 8,019,247 B2
(45) Date of Patent: Sep. 13, 2011

(54) FUSING DEVICE AND IMAGE FORMING APPARATUS WHICH TURNS ON AN EDGE HEATER

(75) Inventors: Ayako Mito, Miyagi (JP); Ryuichi Kikegawa, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 286 days.

(21) Appl. No.: 12/358,357

(22) Filed: Jan. 23, 2009

(65) Prior Publication Data

US 2009/0196643 A1 Aug. 6, 2009

(30) Foreign Application Priority Data

Feb. 1, 2008 (JP) ..... 2008-023189

(51) Int. Cl.
*G03G 15/20* (2006.01)

(52) U.S. Cl. ..... 399/69; 399/334

(58) Field of Classification Search ..... 399/67, 399/69, 70, 334
See application file for complete search history.

(56) References Cited

U.S. PATENT DOCUMENTS

| | | | | |
|---|---|---|---|---|
| 7,212,759 | B2 * | 5/2007 | Kishi et al. | 399/69 |
| 7,308,216 | B2 | 12/2007 | Kishi et al. | |
| 7,333,743 | B2 | 2/2008 | Kishi et al. | |
| 7,343,113 | B2 | 3/2008 | Matsusaka et al. | |
| 7,356,270 | B2 | 4/2008 | Matsusaka et al. | |
| 7,366,432 | B2 | 4/2008 | Kishi et al. | |
| 2006/0039713 | A1 | 2/2006 | Kishi et al. | |
| 2006/0051111 | A1 | 3/2006 | Kishi et al. | |
| 2006/0051119 | A1 | 3/2006 | Kishi et al. | |
| 2006/0051120 | A1 * | 3/2006 | Kishi et al. | 399/69 |
| 2008/0145088 | A1 | 6/2008 | Matsusaka et al. | |

FOREIGN PATENT DOCUMENTS

| | | |
|---|---|---|
| JP | 2000-315567 | 11/2000 |
| JP | 2004-258550 | 9/2004 |
| JP | 2004-326098 | 11/2004 |
| JP | 2005-216784 | 8/2005 |
| JP | 2005-216785 | 8/2005 |

* cited by examiner

*Primary Examiner* — David Gray
*Assistant Examiner* — Billy J Lactaoen
(74) *Attorney, Agent, or Firm* — Oblon, Spivak, McClelland, Maier & Neustadt, L.L.P.

(57) ABSTRACT

A disclosed fusing device includes a fusing part; a pressing part rotatably pressed against the fusing part to form a fusing nip for fusing a toner image onto a sheet; a capacitor; a center heater for heating a center portion of the fusing part; an edge heater for heating edge portions of the fusing part; an auxiliary heater for heating the fusing part; and a control unit configured to continuously turn off the edge heater and to turn on the center heater and the auxiliary heater to heat the fusing part during a fusing process of one or more small-size sheets having a width less than that of the heat generating portion of the center heater. The control unit is configured to turn on the edge heater to heat the fusing part when the capacitor stops discharging electricity during a consecutive fusing process of multiple small-size sheets.

5 Claims, 7 Drawing Sheets

FUSING DEVICE AND IMAGE FORMING APPARATUS WHICH TURNS ON AN EDGE HEATER

BACKGROUND OF THE INVENTION

1. Field of the Invention

A certain aspect of the present invention relates to a fusing device and an image forming apparatus including the fusing device.

2. Description of the Related Art

A fusing roller of an image forming apparatus such as a copier or a printer typically includes a heat generator such as a halogen heater and is pressed against a pressing roller to form a nip (fusing nip). Such a fusing roller fuses a toner image onto a recording sheet (may simply be called a sheet) fed into the nip by the pressure at the nip and the radiant heat from the heat generator.

In the field of high-speed, low power-consumption image forming apparatuses, there is a trend to make a fusing roller thinner to be able to promptly raise the temperature of the fusing roller and thereby to smoothly fuse a toner image onto a sheet. Meanwhile, patent document 1 discloses a method for reducing the heat-up time of a heating part (fusing roller) by supplementarily supplying power to a heat generator (capacitor heater) of the heating part from an auxiliary power supply (capacitor). Also, patent document 2 discloses a method for improving the power efficiency by supplementarily supplying power to a heat generator of a heating part from an auxiliary power supply while a sheet is being passed through a fusing nip.

Further, there is a known technology for fusing a toner image onto a sheet where a rod-like central light distribution AC heater (center heater) having a light-emitting part in the center and a rod-like edge light distribution AC heater (edge heater) having light-emitting parts at the corresponding ends are selectively used according to the size of the sheet.

With a thin fusing roller, the temperature distribution in the center and edge portions of the roller tends to become non-uniform and the temperature rise rate of the edge portions of the roller tends to become slower than that of the center portion during warm-up. Also, since the heat capacity of such a thin fusing roller is small, the temperature of the edge portions of the roller falls significantly when fusing a toner image onto a sheet immediately after start-up. To reduce or solve this problem, an auxiliary heater (an AC halogen heater or a capacitor heater) having an edge light distribution or a flat light distribution (having a heat generator that covers the entire length of the heater) is used during warm-up or a fusing process.

However, when small-size sheets (e.g., A5-size sheets) are fed consecutively into the fusing nip (when small sheets are processed consecutively), the temperature of a non-fusing portion (non-sheet-passing portion that is not in contact with the sheets) in the width direction of the fusing roller rises significantly, the temperature of a fusing portion (sheet-passing portion that is in contact with the sheets) falls significantly, and as a result the fusing performance is reduced. Also, when small-size sheets are fed consecutively into a fusing nip or during a next print job after consecutive feeding of small-size sheets, the amount of remaining electric energy in the auxiliary power supply (capacitor) may decrease and the auxiliary power supply may become unable to supply power. This in turn causes an unbalanced temperature distribution in the width direction of the fusing roller and reduces the fusing performance.

[Patent document 1] Japanese Patent Application Publication No. 2000-315567

[Patent document 2] Japanese Patent Application Publication No. 2005-216784

SUMMARY OF THE INVENTION

Aspects of the present invention provide a fusing device and an image forming apparatus including the fusing device that solve or reduce one or more problems caused by the limitations and disadvantages of the related art.

According to an aspect of the present invention, a fusing device includes a fusing part; a pressing part rotatably pressed against the fusing part to form a fusing nip for fusing a toner image onto a sheet; a capacitor; a center heater including a heat generating portion configured to heat a center portion in the width direction of the fusing part; an edge heater including heat generating portions configured to heat edge portions in the width direction of the fusing part; an auxiliary heater configured to heat the fusing part; and a control unit configured to continuously turn off the edge heater and to turn on the center heater and the auxiliary heater to heat the fusing part during a fusing process of one or more small-size sheets having a width less than that of the heat generating portion of the center heater. The control unit is configured to turn on the edge heater to heat the fusing part when the capacitor stops discharging electricity during a consecutive fusing process of multiple small-size sheets.

According to another aspect of the present invention, a fusing device includes a fusing part; a pressing part rotatably pressed against the fusing part to form a fusing nip for fusing a toner image onto a sheet; a capacitor; a center heater including a heat generating portion configured to heat a center portion in the width direction of the fusing part; an edge heater including heat generating portions configured to heat edge portions in the width direction of the fusing part; an auxiliary heater configured to heat the fusing part; and a control unit configured to continuously turn off the edge heater and to turn on the center heater and the auxiliary heater to heat the fusing part during a fusing process of a small-size sheet having a width less than that of the heat generating portion of the center heater. If a charge voltage of the capacitor is lower than a discharge enabling voltage and the auxiliary heater is not turned on when the fusing process is started, the control unit is configured to turn on the center heater and the edge heater to heat the fusing part.

Still another aspect of the present invention provides an image forming apparatus including the fusing device described above.

DESCRIPTION OF THE PREFERRED EMBODIMENTS

Preferred embodiments of the present invention are described below with reference to the accompanying drawings.

Exemplary configurations of a fusing device and an image forming apparatus according to an embodiment of the present invention are described below.

Figure 1:
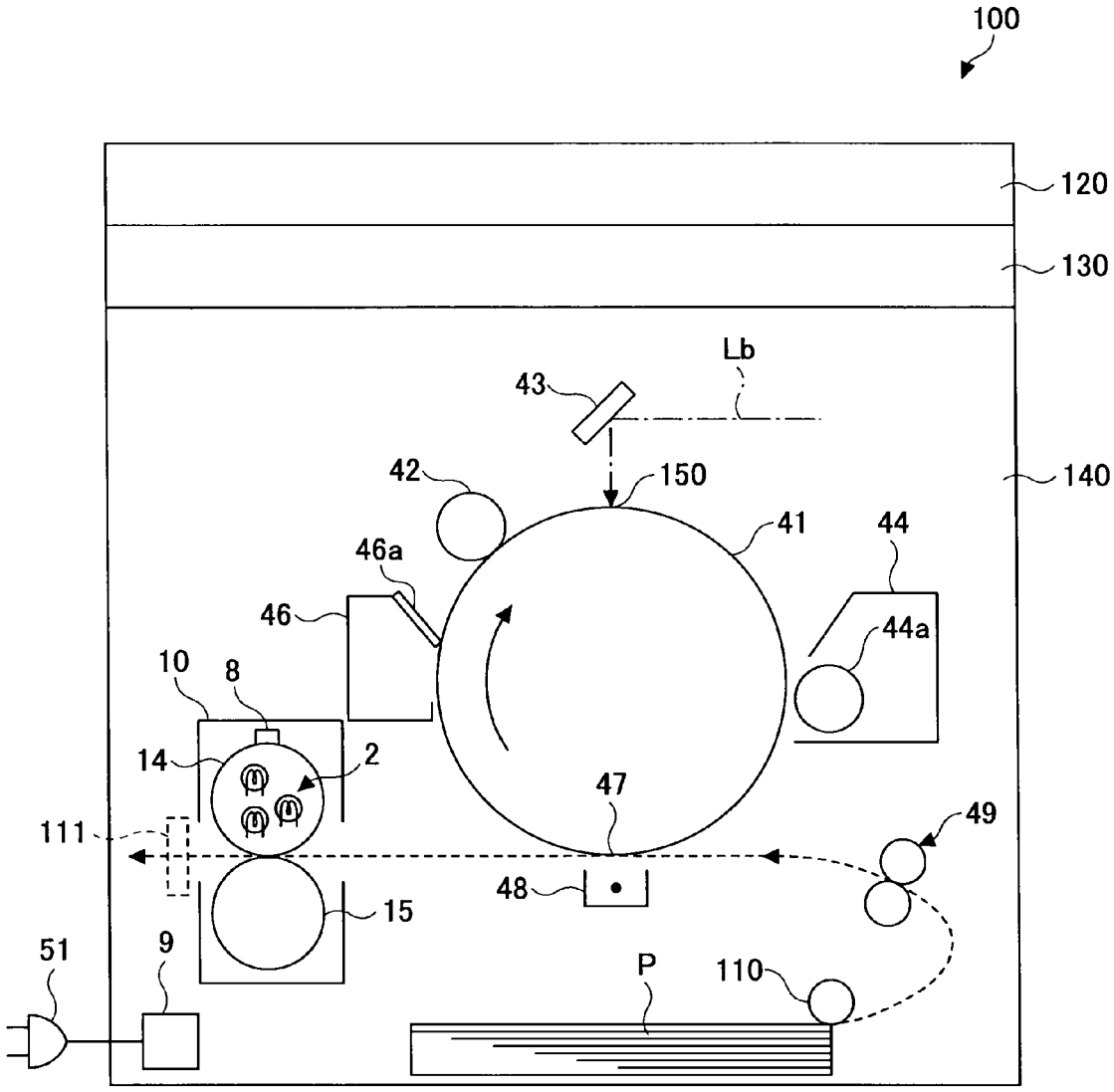
FIG. 1 is a schematic diagram illustrating a configuration of an image forming apparatus according to an embodiment of the present invention.

FIG. 1 is a schematic diagram illustrating a configuration of an image forming apparatus 100 according to an embodiment of the present invention.

The image forming apparatus 100 includes a scanning unit 130 for scanning a document to generate image data of the document, an automatic document feeder (ADF) 120 for feeding a document to the scanning device 130, and an image forming unit 140 for forming an image according to the image data generated by the scanning unit 130. The image forming unit 140 includes a fusing device 10 according to an embodiment of the present invention.

The image forming unit 140 also includes a rotatable drum-shaped photoconductor 41 provided as an example of an image carrier. The image forming unit 140 further includes a charging unit 42 implemented as a charging roller, a mirror 43 constituting a part of an exposing unit, a developing unit 44 including a developing roller 44*a*, a transfer unit 48 for transferring a developed image onto a recording sheet P, and a cleaning unit 46 including a blade 46*a* that is in contact with a circumferential surface of the photoconductor 41. These components are arranged around the photoconductor 41 in the order mentioned along the rotational direction of the photoconductor 41 indicated by the arrow shown in FIG. 1. The photoconductor 41 is exposed (scanned) at a position between the charging unit 42 and the developing roller 44*a* by an exposing beam Lb emitted by the exposing unit and reflected by the mirror 43. The position where the photoconductor 41 is exposed by the exposing beam Lb is called an exposure position 150.

The transfer unit 48 is disposed so as to face the lower surface of the photoconductor 41. The position on the photoconductor 41 facing the transfer unit 48 is called a transfer position 47. A pair of resist rollers 49 is disposed upstream of the transfer position 47 with respect to the conveying direction of the recording sheet P. Plural recording sheets P are stacked in a paper-feed tray (not shown) and are fed one by one by a paper-feed roller 110 to the resist rollers 49 through a conveying guide (not shown). The fusing device 10 of this embodiment is disposed downstream of the transfer position 47 with respect to the conveying direction of the recording sheet P. A paper ejection sensor 111 is provided in a paper ejection path on the output side of a fusing nip of the fusing device 10. The paper ejection sensor 111 detects the last recording sheet P in a print job being ejected from the transfer nip and outputs a detection signal. The detection signal is used to determine the end of the print job.

An exemplary image forming process or a print job in the image forming apparatus 100 is described below. The photoconductor 41 is caused to start rotating by a drive unit (not shown) and is uniformly charged in the dark by the charging unit 42. Then, the photoconductor 41 is scanned at the exposure position 150 by the exposing beam Lb emitted from the exposing unit and reflected by the mirror 43. As a result, a latent image is formed on the photoconductor 41 according to image data. The latent image moves to the developing unit 44 as the photoconductor 41 rotates and is developed by the developing unit 44 to form a toner image.

Meanwhile, the recording sheet P in the paper-feed tray is fed by the paper-feed roller 110 through the conveying path indicated by a dotted line in FIG. 1 to the resist rollers 49. The recording sheet P is temporarily held at the resist rollers 49 until a feed timing such that the recording sheet P and the toner image on the photoconductor 41 meet at the transfer position 47. At the feed timing, the resist rollers 49 are rotated to feed the recording sheet P to the transfer position 47. At the transfer position 47, the toner image on the photoconductor 41 meets the recording sheet P and is transferred onto the recording sheet P by an electric field of the transfer unit 48.

The recording sheet P carrying the transferred toner image is conveyed to the fusing device 10. When passing through the fusing device 10, the toner image is fused onto the recording sheet P. Then, the recording sheet P with the fused toner image is ejected onto a paper catch part (not shown).

Meanwhile, residual toner remaining on the photoconductor 41 after the transfer process at the transfer position 47 is moved to the cleaning unit 46 as the photoconductor 41 rotates and is removed by the cleaning unit 46 to prepare for the next image formation.

A print job is performed as described above. Here, a print job indicates a set of image forming processes (or print processes) performed in response to one print request. In a print job, either an image is formed on one recording sheet or plural images are formed on plural recording sheets being fed consecutively. The fusing device 10 of this embodiment performs a fusing process according to a print job.

Figure 2B:
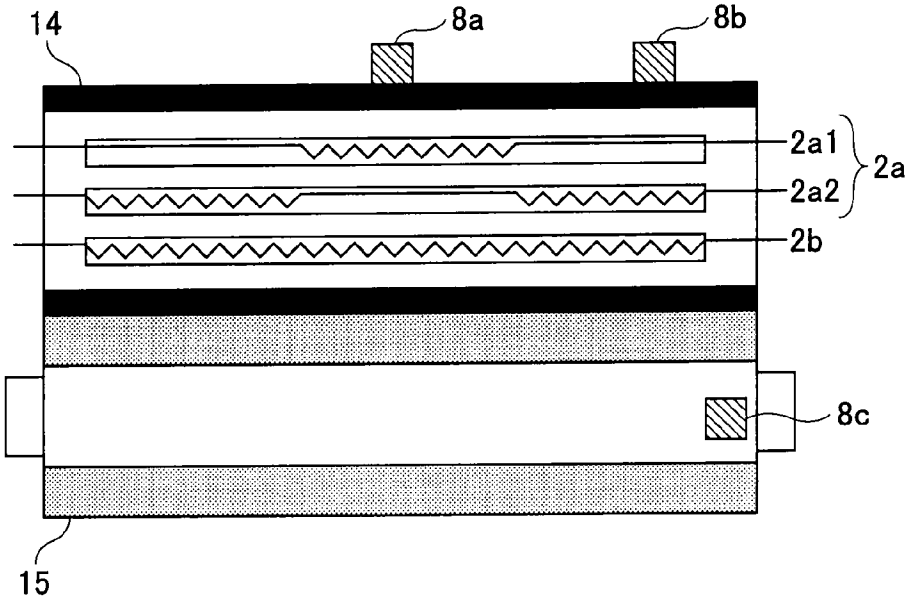
FIGS. 2A and 2B are drawings illustrating a configuration of a fusing device according to an embodiment of the present invention.
Figure 2A:
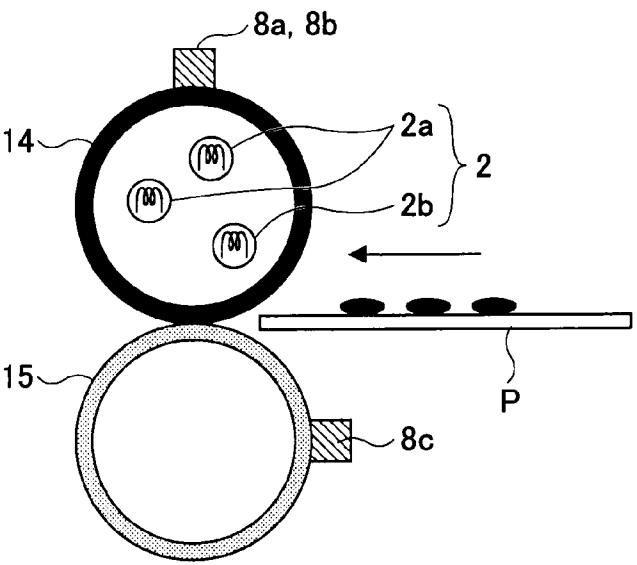

As shown in FIGS. 2A and 2B, the fusing device 10 includes a fusing part 14 and a pressing part 15 that are shaped like cylinders and supported so as to be rotatable about axes that are orthogonal to the plane of FIG. 2A on the printed page. The fusing part 14 is used as a heating part and is implemented, for example, as a fusing roller (hereafter, called a fusing roller 14). The pressing part 15 is, for example, implemented as a pressing roller (hereafter, called a pressing roller 15). Inside of the fusing roller 14, heat generators 2 are provided. The heat generators 2 generate heat and thereby heat the fusing roller 14. A temperature detector 8*a* for detecting the surface temperature of a center portion of the fusing roller 14 and a temperature detector 8*b* for detecting the surface temperature of an edge portion of the fusing roller 14 are disposed on the outer surface of the fusing roller 14. Also, a temperature detector 8*c* implemented, for example, by a thermistor for detecting the surface temperature of the pressing roller 15 is disposed on the outer surface of the pressing roller 15.

A main power supply unit 9 (see FIG. 1) supplies power obtained from a commercial power supply (external power supply) 4*a* (see FIG. 3) to the components of the image forming apparatus 100. When a plug 51 attached to a power line is plugged into an outlet 4*a* (e.g., 100 V, 15 A) of the commercial power supply, power is supplied to the main power supply unit 9 from the commercial power supply 4*a*. The heat generators 2, as shown in FIGS. 2A and 2B, include heat generators (main heaters) 2*a* implemented by AC heaters and a heat generator (auxiliary heater (capacitor heater)) 2*b* implemented by a DC heater. For example, the heat generators 2 may be implemented by halogen heaters.

The main heaters 2*a* include a center heater 2*a*1 for heating the center portion in the width direction of the fusing roller 14 and an edge heater 2*a*2 for heating the edge portions of the fusing roller 14. For example, the rated power of the center heater 2*a*1 is 500 W, the rated power of the edge heater 2*a*2 is 700 W, and the rated voltage of the main heaters 2*a* is 100 V. The width of the heat generating portion of the center heater 2*a*1 is, for example, about 200 to 220 mm that corresponds to the width of an A4-size sheet (or the length of an A5-size sheet). The heat generating portions of the edge heater 2*a*2 are disposed outside of the heat generating portion of the center heater 2*a*1 such that they can cover at least the edges of a recording sheet having the largest width among recording sheets used. The heat generating portions of the edge heater 2*a*2 may be made wider than necessary such that the heat generating portion of the center heater 2*a*1 and the heat generating portions of the edge heater 2*a*2 slightly overlap. The auxiliary heater 2*b* is implemented by a flat heater having a heat distribution that is flat throughout the width of the fusing roller 14. Alternatively, the auxiliary heater 2*b* may be implemented by a heater having a heat distribution (light distribution) adjusted in the width direction of the fusing roller 14. For example, the rated power of the auxiliary heater 2*b* is 450 W and the rated voltage is 50 V. In this example, the rated voltage (50 V) of the auxiliary heater 2*b* is different from the rated voltage (100 V) of the main heaters 2*a*. Alternatively, the rated voltage of the auxiliary heater 2*b* may be the same as that of the main heaters 2*a* when an indirect power supply method is employed. In the indirect power supply method, an auxiliary power supply 4*b* (see FIG. 3) is used to supply power to components other than the heat generators 2 and the surplus power of the external power supply (the commercial power supply 4*a*) corresponding to the electric power provided by the auxiliary power supply 4*b* is supplied to the heat generators 2. Also, the auxiliary heater 2*b* may be implemented by a heater having a heat distribution (light distribution) adjusted in the width direction of the fusing roller 14. For example, a heater having a light distribution that is adjusted so that the heat generation in the center portion of the fusing roller 14 becomes greater than that in the edge portions or a heater having a light distribution that is adjusted so that the heat generation in the edge portions of the fusing roller 14 becomes greater than that in the center portion may be used as the auxiliary heater 2*b*.

The sum of the rated powers of the center heater 2*a*1, the edge heater 2*a*2, and the auxiliary heater 2*b* is preferably greater than or equal to 80% of the maximum AC power consumption of the image forming apparatus 100. For example, when the power of the commercial power supply 4*a* is 1500 W (100 V, 15 A in Japan) and the maximum AC power consumption of the image forming apparatus 100 is 1500 W, the sum of the rated powers of the heaters is preferably greater than or equal to 1200 W. Also, the sum of the rated powers of the center heater 2*a*1, the edge heater 2*a*2, and the auxiliary heater 2*b* may be greater than or equal to the maximum AC power consumption of the image forming apparatus 100. In this case, based on the above assumption, the sum of the rated powers of the heaters becomes greater than or equal to 1500 W.

The body of the fusing roller 14 is preferably made of a metal such as aluminum or iron to achieve enough durability and resistance to deformation caused by pressure. The thickness of the body of the fusing roller 14 is preferably less than 5 mm and more preferably less than or equal to 1 mm so that the fusing roller 14 can be quickly heated up to a predetermined temperature in a short period of time at start-up. For example, the thickness of the body of the fusing roller 14 may be set at 0.7 mm. A release layer is preferably formed on the surface of the fusing roller 14 to prevent toner from adhering to the surface of the fusing roller 14. Also, the inner surface of the fusing roller 14 is preferably blackened so that the radiant heat from the heat generators 2 (e.g., halogen heaters) is efficiently absorbed.

The pressing roller 15 includes a metal cored bar and an elastic layer made of, for example, rubber and formed on the metal cored bar. The pressing roller 15 has a greater heat capacity than the fusing roller 14. The pressing roller 15 is pressed against the fusing roller 14 and thereby forms a fusing nip. The recording sheet P such as a paper sheet on which a toner image is formed is passed through the fusing nip to fuse the toner image onto the recording sheet P by heat and pressure. Alternatively, a pressing roller having a foam layer may be used as the pressing roller 15 that forms a fusing nip with the fusing roller 14.

Figure 3:
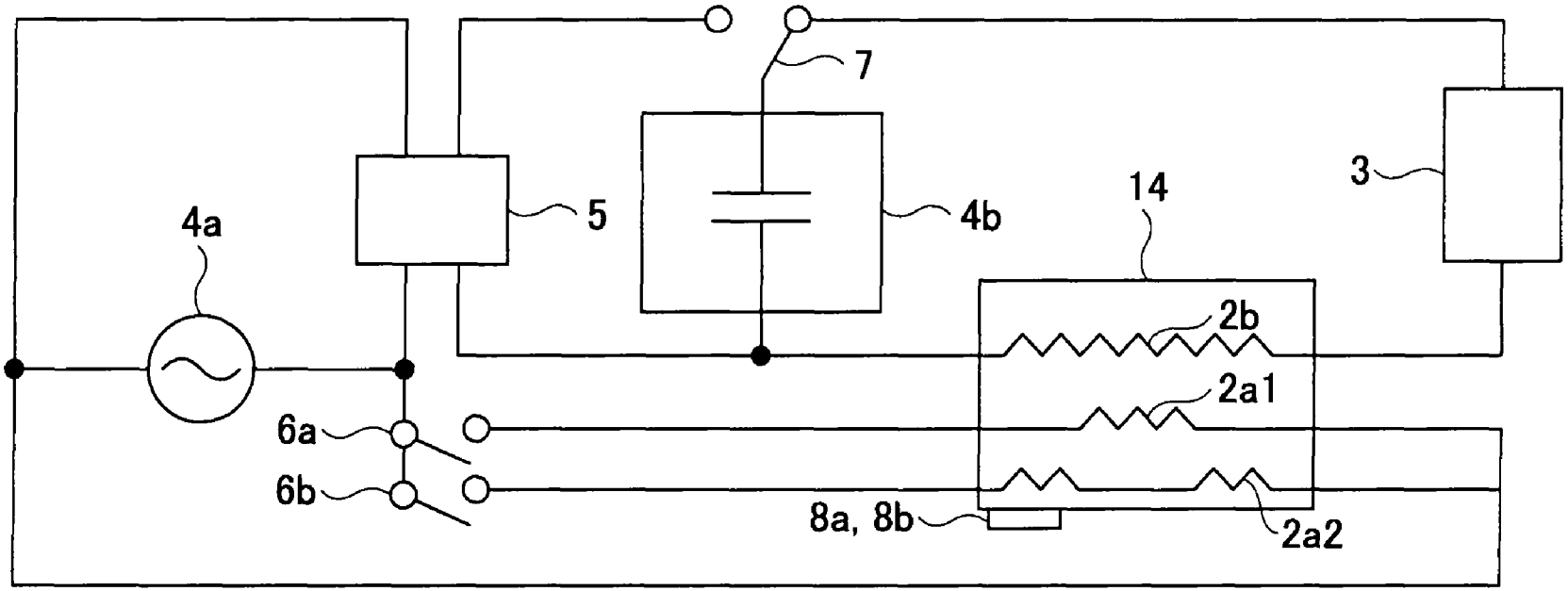
FIG. 3 is a circuit diagram of a heating system of a fusing device according to an embodiment of the present invention.

FIG. 3 is a circuit diagram of a heating system of the fusing device 10 of this embodiment. As shown in FIG. 3, the heating system includes the heat generators 2 (the center heater 2*a*1, the edge heater 2*a*2, and the auxiliary heater 2*b*) for heating the fusing roller 14 and a charging unit 5 capable of supplying power obtained from the commercial power supply 4*a* to the auxiliary power supply 4*b* that is a capacitor. The charging unit 5 adjusts the voltage of the AC power from the commercial power supply 4*a*, converts the AC power into DC power, and charges the auxiliary power supply 4*b* with the DC power. The heating system also includes a main power supply switch 6*a* for controlling power to the center heater 2*a*1 and a main power supply switch 6*b* for controlling power to the edge heater 2*a*2. The main power supply switches 6*a* and 6*b* are controlled by a first control unit (not shown). The first control unit is supplied with power from the main power supply unit 9 regardless of whether the power switch of the image forming apparatus 100 is turned on or off. The first control unit controls the main power supply switches 6*a* and 6*b* according to a mode signal from a main control unit (not shown) for controlling the components of the image forming apparatus 100 and temperature detection signals (signals indicating actual surface temperatures of the fusing roller 14) from the temperature detectors 8*a* and 8*b* such that the surface temperatures of the fusing roller 14 match predetermined target temperatures (control temperatures).

In other words, the first control unit sets the target temperatures (control temperatures) of the fusing roller 14 at given values, compares the actual temperatures (detected by the temperature detectors 8*a* and 8*b*) with the target temperatures, and turns on and off the center heater 2*a*1 and the edge heater 2*a*2 based on the comparison results. More specifically, the first control unit sets a target center temperature (center control temperature) of the center portion of the fusing roller 14 at a given value, compares the temperature detected by the temperature detector 8*a* with the target center temperature, and turns on and off the center heater 2*a*1 based on the comparison result. Also, the first control unit sets a target edge temperature (edge control temperature) of the edge portions of the fusing roller 14 at a given value, compares the temperature detected by the temperature detector 8*b* with the target edge temperature, and turns on and off the edge heater 2*a*2 based on the comparison result.

The heating system also includes a second control unit 3. The second control unit 3 is supplied with power from the main power supply unit 9 regardless of whether the power switch of the image forming apparatus 100 is turned on or off.

The second control unit 3 controls power from the auxiliary power supply 4*b* to the auxiliary heater 2*b* according to a mode signal from the main control unit, temperature detection signals from the temperature detectors 8*a* and 8*b*, and an output from an electric energy detecting unit (not shown) for detecting the electric energy (voltage) of the auxiliary power supply 4*b*. The first control unit and the second control unit 3 may be collectively called a control unit. The heating system further includes a charge/discharge switching unit 7 that connects the auxiliary power supply 4*b* either to the charging unit 5 or to the auxiliary heater 2*b* according to a mode signal from the main control unit, temperature detection signals from the temperature detectors 8*a* and 8*b*, and an output from the electric energy detecting unit. When the auxiliary power supply 4*b* is connected to the charging unit 5 by the charge/discharge switching unit 7, the power from the commercial power supply 4*a* is supplied to the auxiliary power supply 4*b* after voltage adjustment and AC-to-DC conversion by the charging unit 5 to charge the auxiliary power supply 4*b*.

When the auxiliary power supply 4*b* is connected to the auxiliary heater 2*b* by the charge/discharge switching unit 7, power is supplied from the auxiliary power supply 4*b* via the second control unit 3 to the auxiliary heater 2*b*. Meanwhile, when the main power supply switch 6*a* is turned on, power is supplied from the commercial power supply 4*a* to the center heater 2*a*1; and when the main power supply switch 6*b* is turned on, power is supplied from the commercial power supply 4*a* to the edge heater 2*a*2. As the auxiliary power supply 4*b*, for example, a rechargeable electric double layer capacitor may be used.

Figure 4:
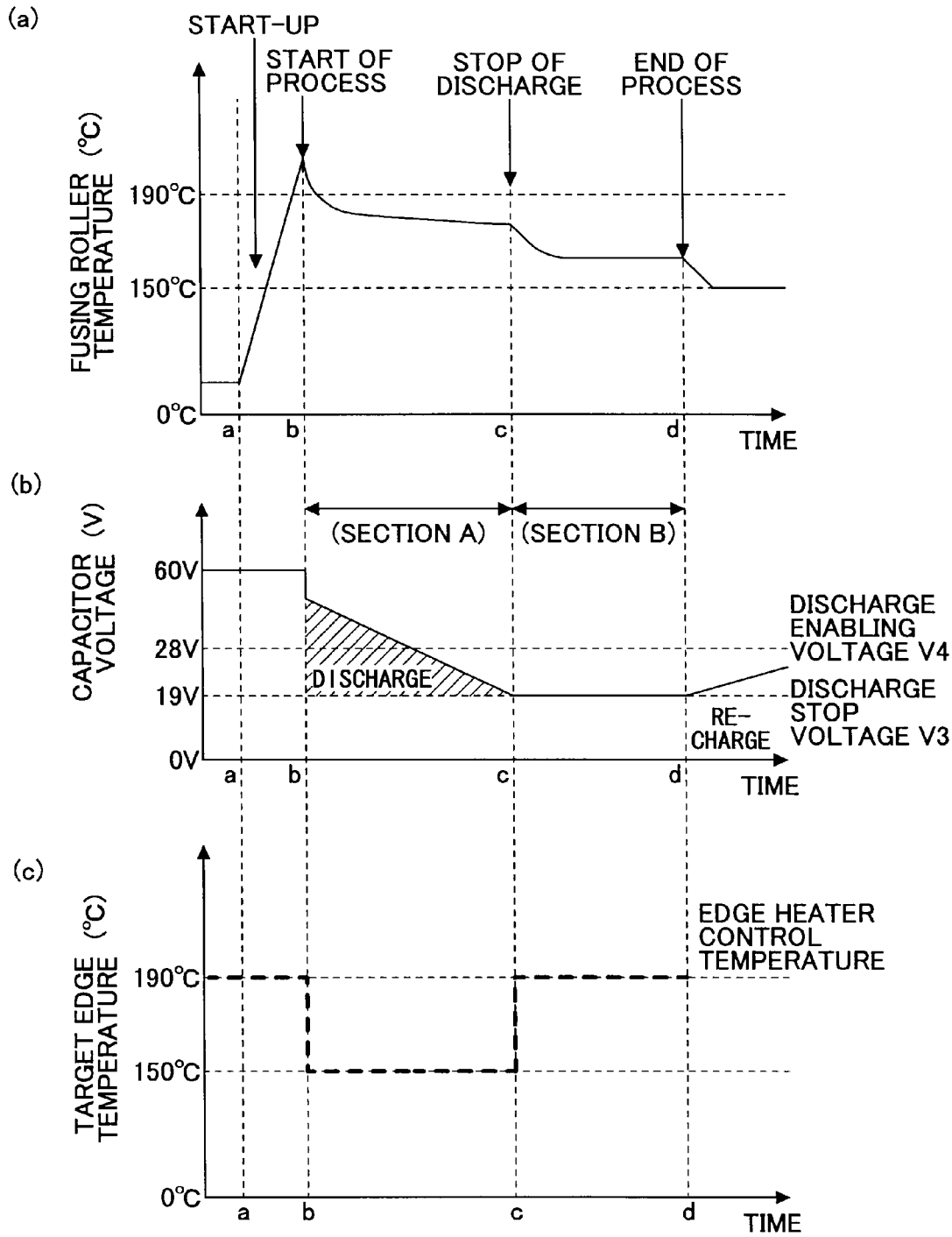
FIG. 4 is a series of graphs showing changes in the temperature (of a center portion) of a fusing roller, the capacitor voltage of an auxiliary power supply, and a target edge temperature in a fusing device according to a first embodiment of the present invention.

FIG. 4 (*b*) shows the discharging characteristics of an electric double layer capacitor used as the auxiliary power supply 4*b* when it is connected to the auxiliary heater 2*b*. The vertical axis of FIG. 4 (*b*) indicates the voltage (capacitor voltage) of the electric double layer capacitor and the horizontal axis indicates time. The voltage of the electric double layer capacitor is high at the beginning of a discharge period and decreases gradually as time passes (during a period between time b and time c in FIG. 4 (*b*)). In other words, the electric double layer capacitor can supply a large amount of power at the beginning of a discharge period but its power decreases near the end of the discharge period. In FIG. 4 (*b*), a discharge stop voltage V3 indicates a voltage (e.g., 19 V) at which the amount of remaining electric energy of the electric double layer capacitor becomes close to zero and the electric double layer capacitor becomes unable to discharge electricity (i.e., the auxiliary power supply 4*b* stops discharging electricity). A discharge enabling voltage V4 indicates a boundary voltage (e.g., 28V) between a voltage at the beginning of a discharge period which is high enough to heat the fusing roller 14 and a voltage that is insufficient to heat the fusing roller 14. The auxiliary power supply 4*b* starts discharging electricity when the capacitor voltage becomes greater than or equal to the discharge enabling voltage V4 and stops discharging electricity when the capacitor voltage becomes less than the discharge enabling voltage V4.

In this embodiment, when a fusing process of small-size sheets with a width less than that of the heat generating portion of the center heater 2*a*2 is started (time b in FIG. 4), the edge heater 2*a*2 is continuously turned off, the center heater 2*a*1 is turned on by supplying power from the commercial power supply 4*a*, and the auxiliary heater 2*b* is turned on by supplying power from the auxiliary power supply 4*b* to heat and maintain the temperature of the fusing roller 14 (the change in the temperature (detected by the temperature detector 8*a*) of a sheet-passing portion (a portion that is in contact with the sheets) of the fusing roller 14 is indicated in FIG. 4 (*a*)). In short, the heaters and the power supplies are controlled as follows:

Center heater 2*a*1 is turned on (power supply is turned on).
Edge heater 2*a*2 is continuously turned off (power supply is turned off).
Auxiliary heater 2*b* is turned on (power supply is turned on).

In the above process, the first control unit sets the target center temperature, for example, at 190° C. and controls the power to the center heater 2*a*1 by turning on and off the main power supply switch 6*a* such that the temperature (detected by the temperature detector 8*a*) of the center portion of the fusing roller 14 matches the target center temperature. Also, to continuously turn off the edge heater 2*a*2, the first control unit forcibly turns off the main power supply switch 6*b* or sets the target edge temperature always at a first temperature (e.g., 150° C.) that is lower than the actual temperature (detected by the temperature detector 8*b*) of the edge portions of the fusing roller 14. Thus, the first control unit controls power to the heaters to maintain the temperature of the sheet-passing portion (the center portion) of the fusing roller 14 at a level necessary for fusing (during a period between time b and time c in FIG. 4 (*a*)).

In FIG. 4 (*b*), it is assumed that printing is performed on multiple small-size sheets in one print job and a fusing process is performed consecutively on the multiple small-size sheets (consecutive fusing process). During the consecutive fusing process (between time b and time d in FIG. 4 (*b*)), the capacitor voltage of the auxiliary power supply 4*b* falls to the discharge stop voltage V3 due to discharge (time c in FIG. 4 (*b*)), the power from the auxiliary power supply 4*b* to the auxiliary heater 2*b* stops, and as a result the auxiliary heater 2*b* is turned off (between time c and time d in FIG. 4 (*b*)).

However, the fusing process for the small-size sheets is continued (between time c and time d in FIG. 4 (*b*)) even after the auxiliary heater 2*b* is turned off. In a related-art fusing device, the heaters and the power supplies are controlled as follows:

Center heater 2*a*1 is turned on (power supply is turned on).
Edge heater 2*a*2 is continuously turned off (power supply is turned off).
Auxiliary heater 2*b* is continuously turned off (power supply is turned off).

Here, "Center heater 2*a*1 is turned on" indicates that the power to the center heater 2*a*1 is being controlled by turning on and off the main power supply switch 6*a* such that the temperature (detected by the temperature detector 8*a*) of the center portion of the fusing roller 14 matches the target center temperature set by the first control unit (this also applies to other embodiments described below). More specifically, the center heater 2*a*1 is continuously turned on while the actual temperature is lower than the target center temperature and is repeatedly turned on and off when the actual temperature becomes close to the target center temperature to maintain the actual temperature at or near the target center temperature. Also, "Edge heater 2*a*2 is continuously turned off" indicates that the power to the edge heater 2*a*2 is forcibly turned off; or the target edge temperature is always set at a level below the actual temperature (detected by the temperature detector 8*b*) so that power is not supplied to the edge heater 2*a*2 (this also applies to other embodiments described below).

With a related-art fusing device, when the auxiliary heater 2*b* is turned off as described above, the temperature of the sheet-passing portion, particularly the temperature at positions (corresponding to the edges of the small-size sheets) close to the edge portions, falls significantly and the fusing performance is reduced.

In embodiments of the present invention, this problem is reduced or solved as described below.

A fusing device according to a first embodiment of the present invention is described below. Also in the fusing device 10 of the first embodiment, the edge heater 2*a*2 is continuously turned off and the center heater 2*a*1 and the auxiliary heater 2*b* are turned on to heat the fusing roller 14 during a fusing process of small-size sheets. The fusing device 10 of the first embodiment is different from the above example in that when the auxiliary power supply 4*b* stops discharging electricity (when the capacitor voltage of the auxiliary power supply 4*b* falls to the discharge stop voltage V3) during a consecutive fusing process of multiple small-size sheets, the edge heater 2*a*2 is turned on to heat the fusing roller 14. In short, after the auxiliary power supply 4*b* stops discharging electricity, the heaters of the fusing device 10 of the first embodiment are controlled as follows:

Center heater 2*a*1 is turned on (power supply is turned on).

Edge heater 2*a*2 is turned on (power supply is turned on).

Auxiliary heater 2*b* is continuously turned off (power supply is turned off).

When the auxiliary power supply 4*b* stops discharging electricity during a consecutive fusing process of multiple small-size sheets (at time c in FIG. 4 (*b*), the first control unit sets the target edge temperature of the fusing roller 14 at a second temperature (for example, at 190° C. that is the same as the target center temperature or at a temperature higher than or lower than the target center temperature) that is higher than the first temperature (150° C. in FIG. 4 (*c*)) to turn on the edge heater 2*a*2 and thereby to heat the fusing roller 14 up to the second temperature. Here, "Edge heater 2*a*2 is turned on" indicates that the power to the edge heater 2*a*2 is being controlled by turning on and off the main power supply switch 6*b* such that the temperature (detected by the temperature detector 8*b*) of the edge portions of the fusing roller 14 matches the target edge temperature set by the first control unit (this also applies to other embodiments described below). More specifically, the edge heater 2*a*2 is continuously turned on while the actual temperature is lower than the target edge temperature and is repeatedly turned on and off when the actual temperature becomes close to the target edge temperature. With this control method, the temperature of the sheet-passing portion (the center portion) of the fusing roller 14 falls to a level that is slightly lower than that before the auxiliary heater 2*b* is turned off, but is still maintained at a level that is enough for fusing (during a period between time c and time d in FIG. 4 (*a*)).

After the fusing process is completed (at time d in FIG. 4 (*b*)), the auxiliary power supply 4*b* is recharged.

Thus, with the above control method, the temperature fall at the sheet-passing portion of the fusing roller 14 due to the turning off of the auxiliary heater 2*b* is compensated for by the heat generated by the edge heater 2*a*2. This in turn improves the fusing performance of the fusing device 10.

A fusing device according to a second embodiment of the present invention is described below. Also in the fusing device 10 of the second embodiment, the edge heater 2*a*2 is continuously turned off and the center heater 2*a*1 and the auxiliary heater 2*b* are turned on to heat the fusing roller 14 during a fusing process of small-size sheets. The fusing device 10 of the second embodiment is different from the above embodiment in that when the capacitor voltage (discharge voltage) of the auxiliary power supply 4*b* falls to a predetermined voltage between a full charge voltage (e.g., 60 V) and the discharge stop voltage V3 (e.g., 19 V) during a consecutive fusing process of multiple small-size sheets, the target edge temperature of the fusing roller 14 is set at a third temperature (e.g., 170° C.) between the first temperature (e.g., 150° C.) and the second temperature (e.g., 190° C.) in the first embodiment to turn on the edge heater 2*a*2 and thereby to heat the fusing roller 14 up to the third temperature. The predetermined voltage in the above description may be set at any value according to the capacity and/or the purpose of the auxiliary power supply 4*b*. For example, the predetermined voltage may be set at the discharge enabling voltage V4 (e.g., 28 V).

In short, when the capacitor voltage of the auxiliary power supply 4*b* falls to the predetermined voltage, the heaters of the fusing device 10 of the second embodiment are controlled as follows:

Center heater 2*a*1 is turned on (power supply is turned on).

Edge heater 2*a*2 is turned on (power supply is turned on).

Auxiliary heater 2*b* is turned on (power supply is turned on).

In this case, the first control unit sets the target temperatures as follows:

Target center temperature is set at a normal temperature (e.g., 190° C.) for a fusing process.

Target edge temperature is set at the third temperature (e.g., 170° C.).

Then, when the auxiliary power supply 4*b* stops discharging electricity (when the capacitor voltage of the auxiliary power supply 4*b* falls to the discharge stop voltage V3) during the consecutive fusing process of multiple small-size sheets, the target edge temperature of the fusing roller 14 is set at the second temperature to cause the edge heater 2*a*2 to heat the fusing roller 14 up to the second temperature. In short, after the discharge of the auxiliary power supply 4*b* stops, the heaters of the fusing device 10 of the second embodiment are controlled as follows:

Center heater 2*a*1 is turned on (power supply is turned on).

Edge heater 2*a*2 is turned on (power supply is turned on).

Auxiliary heater 2*b* is continuously turned off (power supply is turned off).

In this case, the first control unit sets the target temperatures as follows:

Target center temperature is set at a normal temperature (e.g., 190° C.) for a fusing process.

Target edge temperature is set at the second temperature (e.g., 190° C.).

In the second embodiment, the third temperature used as the target edge temperature may be set freely according to the circumstances. For example, there is a case where the input AC voltage of the commercial power supply 4*a* becomes lower than the rated voltage. If the input AC voltage becomes lower than or equal to 90% of the rated voltage of 100 V, i.e., falls to 90 V or lower, the power of the center heater 2*a*1 falls to about 430 W, the power of the edge heater 2*a*2 falls to about 600 W, and the total AC heater power decreases to about 85%. In this case, the third temperature may be set at a value slightly higher than normal (e.g., at 180° C.).

Figure 5:
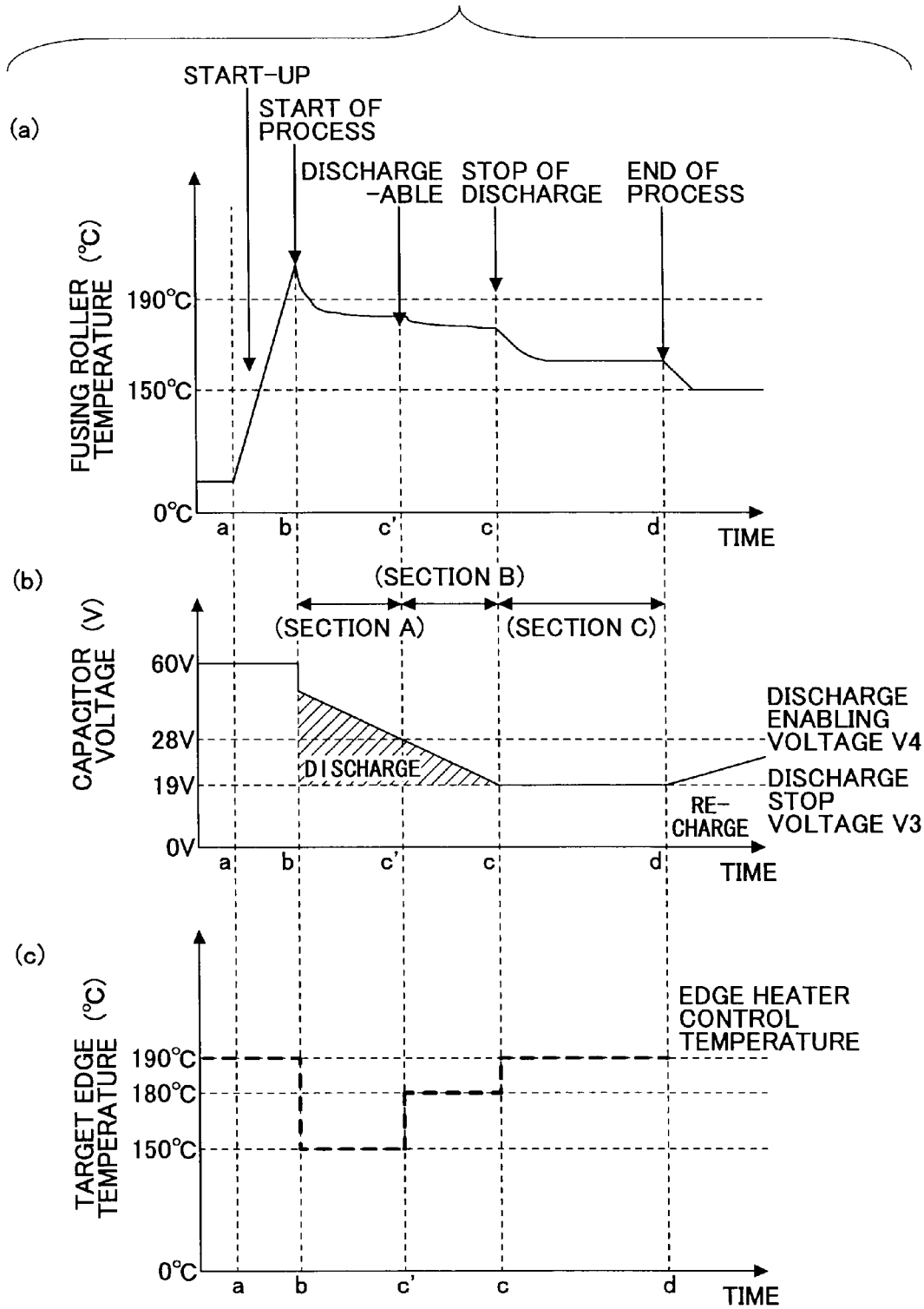
FIG. 5 is a series of graphs showing changes in the temperature (of a center portion) of a fusing roller, the capacitor voltage of an auxiliary power supply, and a target edge temperature in a fusing device according to a second embodiment of the present invention.

FIG. 5 (*c*) shows changes in the target edge temperature. Meanwhile, FIG. 5 (*a*) shows changes in the temperature (detected by the temperature detector 8*a*) of the sheet-passing portion of the fusing roller 14 and FIG. 5 (*b*) shows changes in the capacitor voltage of the auxiliary power supply 4*b*.

Section A (between time b and time c') in FIG. 5 indicates a period from the time when a continuous fusing process of multiple small-size sheets is started (feeding of the sheets to the fusing nip is started) to the time when the capacitor voltage of the auxiliary power supply 4*b* falls to the predetermined voltage (the discharge enabling voltage V4). In section A, the first control unit sets the target edge temperature at the first temperature (150° C.) to continuously turn off the edge heater 2*a*2.

Section B (between time c' and time c) in FIG. 5 indicates a period during which the capacitor voltage of the auxiliary power supply 4*b* falls gradually from the predetermined voltage (the discharge enabling voltage V4) to the discharge stop voltage V3. In section B, the first control unit sets the target edge temperature at the third temperature (180° C.) to turn on the edge heater 2*a*2 and thereby to heat the edge portions of the fusing roller 14 up to the third temperature.

Section C (between time c and time d) in FIG. 5 indicates a period from the time when the auxiliary power supply 4*b* stops discharging electricity to the time when the fusing process is completed. In section C, the first control unit sets the target edge temperature at the second temperature (190° C.) to cause the edge heater 2*a*2 to heat the edge portions of the fusing roller 14 up to the second temperature.

During a consecutive fusing process of small-size sheets, if the edge heater 2*a*2 is turned on only after the auxiliary power supply 4*b* stops discharging electricity, i.e., after the auxiliary heater 2*b* is turned off, the temperature of the sheet-passing portion of the fusing roller 14 may fall significantly and the edge heater 2*a*2 may not be able to sufficiently and in a timely manner compensate for the temperature fall of the fusing roller 14. This may occur when, for example, the input AC voltage of the commercial power supply 4*a* is lower than the rated voltage. For this reason, in this embodiment, the edge heater 2*a*2 is turned on before the auxiliary power supply 4*b* stops discharging electricity and the auxiliary heater 2*b* is turned off (i.e., when the capacitor voltage of the auxiliary power supply 4*b* falls to the predetermined voltage (e.g., the discharge enabling voltage V4)) to preheat the edge portions of the fusing roller 14 and thereby to increase the temperature of the sheet-passing portion of the fusing roller 14 to a certain level (during a period between time c' and time c in FIG. 5 (*a*)). This method or configuration makes it possible to prevent the temperature of the fusing roller 14 (sheet-passing portion) from drastically decreasing when the auxiliary heater 2*b* is turned off.

After the fusing process is completed (at time d in FIG. 5 (*b*)), the auxiliary power supply 4*b* is recharged.

A fusing device according to a third embodiment of the present invention is described below. Also in the fusing device 10 of the third embodiment, the edge heater 2*a*2 is continuously turned off and the center heater 2*a*1 and the auxiliary heater 2*b* are turned on to heat the fusing roller 14 during a fusing process of small-size sheets. The fusing device 10 of the third embodiment is different from the above embodiments in that if the auxiliary heater 2*b* is not turned on because the charge voltage (the capacitor voltage) of the auxiliary power supply 4*b* is below the discharge enabling voltage V4 when a fusing process of small-size sheets is started, the center heater 2*a*1 and the edge heater 2*a*2 are turned on to heat the fusing roller 14. In short, when a fusing process of small-size sheets is started, the heaters of the fusing device 10 of the third embodiment are controlled as follows:

Center heater 2*a*1 is turned on (power supply is turned on).

Edge heater 2*a*2 is turned on (power supply is turned on).

Auxiliary heater 2*b* is continuously turned off (power supply is turned off).

In this case, the first control unit sets the target temperatures as follows:

Target center temperature is set at a normal temperature (e.g., 190° C.) for a fusing process.

Target edge temperature is set at the second temperature (e.g., 190° C.).

In the above description, "if the auxiliary heater 2*b* is not turned on because the charge voltage (the capacitor voltage) of the auxiliary power supply 4*b* is below the discharge enabling voltage V4 when a fusing process of small-size sheets is started" indicates a case where the capacitor voltage of the auxiliary power supply 4*b* becomes lower than the discharge enabling voltage V4 because of the previous fusing process of multiple sheets (i.e., the previous print job) and the next print job is started before the auxiliary power supply 4*b* is recharged to the discharge enabling voltage V4 or higher.

Figure 6:
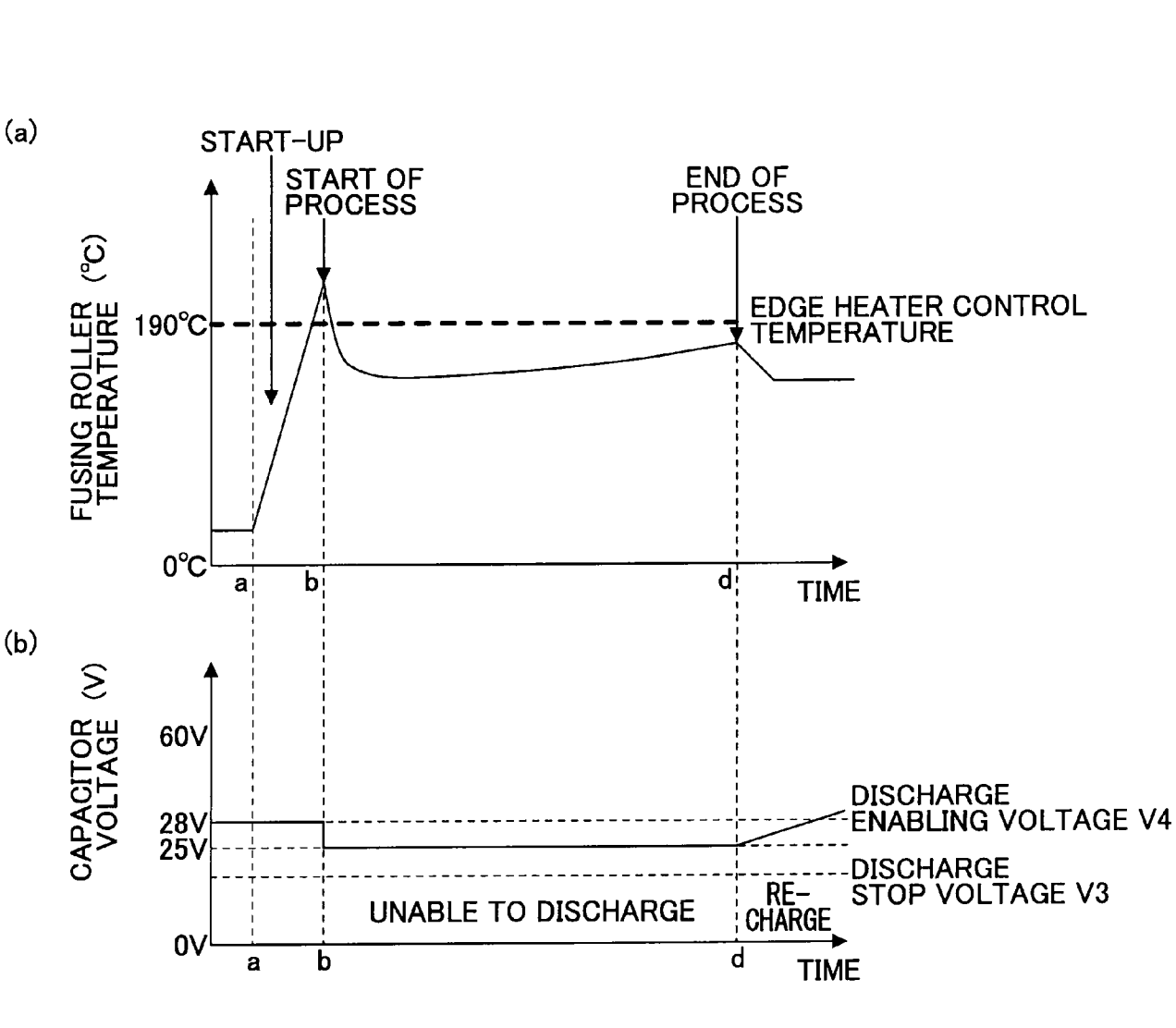
FIG. 6 is a series of graphs showing changes in the temperature (of a center portion) of a fusing roller and the capacitor voltage of an auxiliary power supply in a fusing device according to a third embodiment of the present invention.

FIG. 6 is a series of graphs showing changes in the temperature (detected by the temperature detector 8*a*) of the center portion of the fusing roller 14 and the capacitor voltage of the auxiliary power supply 4*b* according to the third embodiment.

If the charge voltage (the capacitor voltage, in FIG. 6 (*b*) at 25 V) of the auxiliary power supply 4*b* is below the discharge enabling voltage V4 (28 V) when a fusing process of small-size sheets is started (at time b in FIG. 6 (*b*)), the auxiliary power supply 4*b* cannot discharge electricity and cannot turn on the auxiliary heater 2*b*. In the third embodiment, the temperature fall of the sheet-passing portion of the fusing roller 14 caused by the above problem is compensated for by the heat generated by the edge heater 2*a*2 (during a period between time b and time d in FIG. 6 (*a*)). Thus, the third embodiment makes it possible to maintain the temperature of the sheet-passing portion of the fusing roller 14 at a level necessary for fusing and thereby makes it possible to improve the fusing performance.

During the fusing process of small-size sheets (between time b and time d in FIG. 6 (*b*)), most of the electric power of the commercial power supply 4*a* is supplied to the center heater 2*a*1 and the edge heater 2*a*2 and cannot be used to charge the auxiliary power supply 4*b*. Therefore, during the fusing process, the capacitor voltage does not change. The auxiliary power supply 4*b* is recharged after the fusing process is completed (at time d in FIG. 6 (*b*)).

In the above embodiments, the electric power of the auxiliary power supply 4*b* is directly supplied to the auxiliary heater 2*b* used as a heat generator during a fusing process (direct power supply). However, the auxiliary power supply 4*b* may be used in a different manner. For example, during a fusing process, the electric power of the auxiliary power supply 4*b* may be supplied to drive units of components (e.g., rollers) other than the heat generators of the fusing device 10 and the surplus electric power of the external power supply (the commercial power supply 4*a*) may be supplied to the heat generators. Also, during a print job in the entire image forming apparatus 100, the electric power of the auxiliary power supply 4*b* may be supplied to drive units of components (e.g., the ADF 120 and the scanning unit 130) other than the fusing device 10 and the surplus electric power of the external power supply (the commercial power supply 4*a*) may be supplied to the heat generators.

In this case, an image forming apparatus includes the fusing device 10 including the fusing roller 14, the pressing roller 15 that is rotatably pressed against the fusing roller 14 to form a fusing nip for fusing a toner image onto a sheet, the center heater 2*a*1 (first heater) having a heat generating portion for heating the center portion in the width direction of the fusing roller 14, the edge heater 2*a*2 (second heater) having heat generating portions for heating the edge portions in the width direction of the fusing roller 14, and a third heater; and the auxiliary power supply 4*b*. During a print job in this image forming apparatus, the electric power of the auxiliary power supply 4*b* is used to drive components other than the heaters and the surplus electric power of the external power supply (the commercial power supply 4*a*) corresponding to the electric power provided by the auxiliary power supply 4*b* is supplied to the third heater. During a print job for printing images on small-size sheets having a width that is less than that of the heat generating portion of the center heater 2*a*1, the edge heater 2*a*2 is continuously turned off and the center heater 2*a*1 and the third heater are turned on to heat the fusing roller 14. And if the auxiliary power supply 4*b* stops discharging electricity during the print job, the edge heater 2*a*2 is turned on to heat the fusing roller 14. The central heater 2*a*1, the edge heater 2*a*2, and the third heater are, for example, implemented by AC heaters. The third heater may be implemented by a flat heater having a heat distribution that is flat throughout the width of the fusing roller 14. Alternatively, the third heater may be implemented by a heater having a heat distribution (light distribution) adjusted in the width direction of the fusing roller 14.

If the charge voltage of the auxiliary power supply 4*b* is below the discharge enabling voltage V4 and the auxiliary power supply 4*b* is not able to supply power when a fusing process of small-size sheets is started, the center heater 2*a*1 and the edge heater 2*a*2 are preferably turned on to heat the fusing roller 14.

The edge heater 2*a*2 may be continuously turned off either by forcibly turning off the power to the edge heater 2*a*2 or by setting a control target temperature of the fusing roller 14 at a low value. Turning on the center heater 2*a*1 and the third heater means that the center heater 2*a*1 and the third heater are turned on and off during a fusing process according to the surface temperature(s) of the fusing roller 14. In other words, turning on the center heater 2*a*1 and the third heater does not mean that the center heater 2*a*1 and the third heater are always turned on during the fusing process. Instead, it means that the center heater 2*a*1 and the third heater are controlled such that the surface temperature(s) of the fusing roller 14 matches a control target temperature(s). Accordingly, when the surface temperature of the fusing roller 14 exceeds the control target temperature, the center heater 2*a*1 and/or the third heater is turned off. The center heater 2*a*1 and the third heater may be controlled based on the same control target temperature or different control target temperatures.

The sum of the rated powers of the central heater 2*a*1, the edge heater 2*a*2, and the third heater is preferably greater than or equal to 80% of the maximum AC power consumption of the image forming apparatus. For example, when the power of the external power supply (the commercial power supply 4*a*) is 1500 W (100 V, 15 A in Japan) and the maximum AC power consumption of the image forming apparatus 100 is 1500 W, the sum of the rated powers of the heaters is preferably greater than or equal to 1200 W. Also, the sum of the rated powers of the center heater 2*a*1, the edge heater 2*a*2, and the third heater may be greater than or equal to the maximum AC power consumption of the image forming apparatus. In this case, based on the above assumption, the sum of the rated powers of the heaters becomes greater than or equal to 1500 W.

The present invention is not limited to the specifically disclosed embodiments, and variations and modifications may be made without departing from the scope of the present invention.

Figure 7:
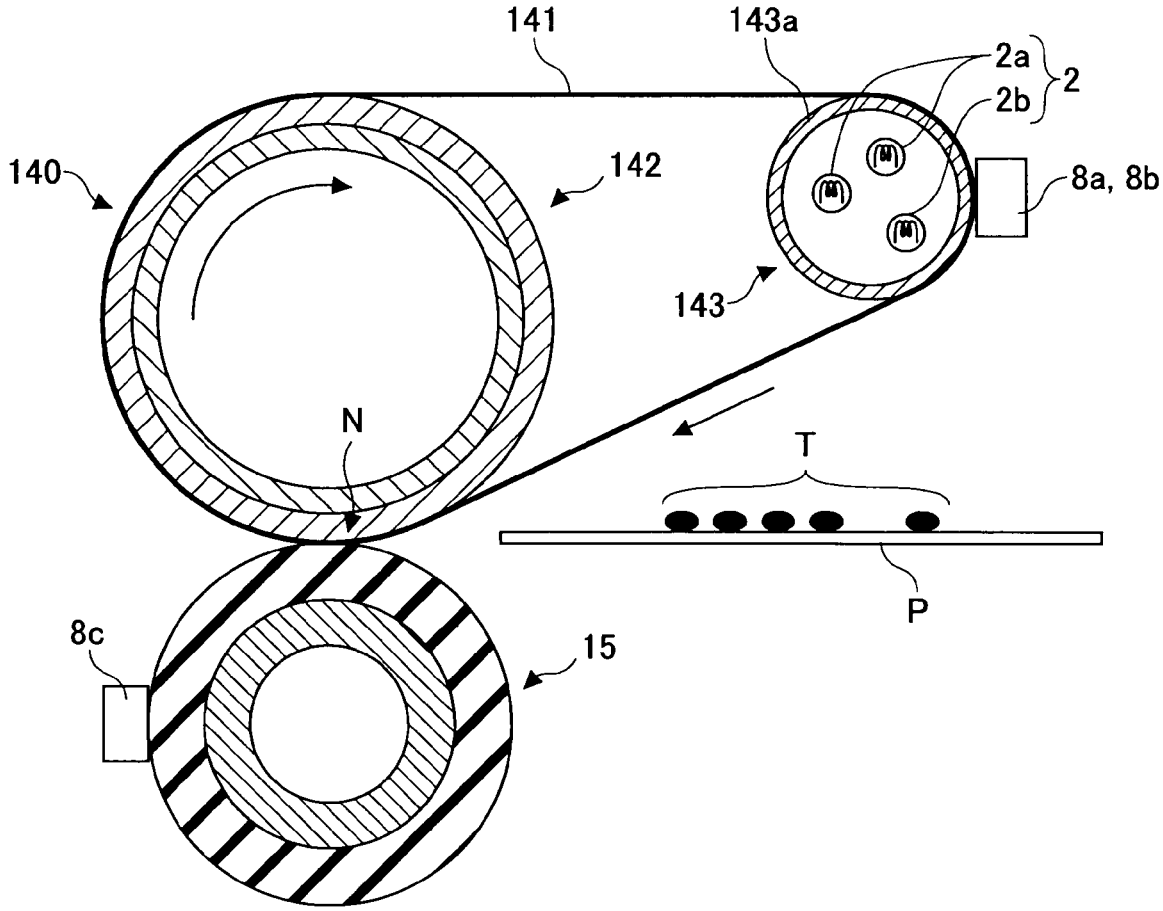
FIG. 7 is a schematic diagram illustrating a configuration of a belt fusing device according to an embodiment of the present invention.

For example, the present invention may also be applied to heaters provided in a heating roller of a belt fusing device as shown in FIG. 7 instead of heaters provided in a fusing roller described in the above embodiments. A belt fusing device 140 shown in FIG. 7 includes a fusing belt 141 used as a fusing part and made of an endless belt, a fusing roller 142 and a heating roller 143 used as backup parts over which the fusing belt 141 is stretched, and a rotatable pressing roller 15 used as a pressing part and disposed so as to face the fusing roller 142 across the fusing belt 141 and to form a fusing nip N with the fusing roller 142. When a recording sheet P with a transferred toner image T is fed into the fusing nip N, the toner image T is fused onto the recording sheet P by heat and pressure. The heating roller 143 includes heat generators 2 including main heaters 2*a* composed of a center heater 2*a*1 and an edge heater 2*a*2 and an auxiliary heater 2*b* inside of its body. When electric power is supplied to the heat generators 2 as described in the above embodiments, the heating roller 143 heats the surface of the fusing belt 141.

According to an embodiment of the present invention, when an auxiliary power supply (capacitor) stops discharging electricity during a consecutive fusing process of multiple small-size sheets, an edge heater is turned on to heat a fusing part. This configuration makes it possible to prevent the temperature of a sheet-passing portion of the fusing part from decreasing drastically.

According to another embodiment of the present invention, when a fusing process of small-size sheets is started, a target temperature of the edge portions of the fusing part is set at a first temperature that is lower than the actual temperature of the edge portions or the power to the edge heater is forcibly turned off to continuously turn off the edge heater. If the auxiliary power supply stops discharging electricity and an auxiliary heater is turned off during a consecutive fusing process of small-size sheets, the temperature of the sheet-passing portion of the fusing part may fall and the fusing performance may be reduced. In this case, the target temperature is set at a second temperature that is higher than the first temperature to turn on the edge heater to heat the fusing part up to the second temperature and thereby to prevent the temperature fall at the sheet-passing portion of the fusing part.

According to another embodiment of the present invention, the edge portions of the fusing part are heated by the edge heater to a certain temperature (third temperature) while the power is still being supplied from the auxiliary power supply and are further heated (to the second temperature) when the auxiliary power supply stops discharging electricity. In other words, the edge portions of the fusing part are heated in stages. This configuration makes it possible to prevent the temperature of the sheet-passing portion of the fusing part from decreasing drastically at once when the auxiliary power supply stops discharging electricity. This configuration is particularly preferable when the power output of the center heater becomes lower than the rated power because the AC voltage input from an external power supply to the fusing device is lower than the rated voltage.

If another fusing process of small-size sheets is performed after a consecutive fusing process of small-size sheets before the charge voltage of the auxiliary power supply reaches a discharge enabling voltage, power is not supplied from the auxiliary power supply and therefore the auxiliary heater is not turned on. As a result, the temperature of the sheet-passing portion of the fusing part falls significantly and the fusing performance is reduced. According to another embodiment of the present invention, this problem is solved or reduced by increasing the target temperature (control temperature) of the edge heater and thereby turning on the edge heater to heat the fusing part when the fusing process is started.

Still another embodiment of the present invention provides an image forming apparatus including a fusing device of the above embodiments. This configuration makes it possible to provide excellent fusing performance even during a print job where printing is performed consecutively on multiple small-size sheets.

Embodiments of the present invention provide a fusing device capable of controlling the temperature of a fusing part so that the fusing performance is not reduced even when a consecutive fusing process of multiple small-size sheets is performed and an image forming apparatus including the fusing device.

The present application is based on Japanese Priority Application No. 2008-023189, filed on Feb. 1, 2008, the entire contents of which are hereby incorporated herein by reference.

What is claimed is:

1. A fusing device, comprising:

a fusing part;

a pressing part rotatably pressed against the fusing part to form a fusing nip for fusing a toner image onto a sheet;

a capacitor;

a center heater including a heat generating portion configured to heat a center portion in the width direction of the fusing part;

an edge heater including heat generating portions configured to heat edge portions in the width direction of the fusing part;

an auxiliary heater configured to heat the fusing part; and a control unit to continuously turn off the edge heater and to turn on the center heater and the auxiliary heater to heat the fusing part during a fusing process of one or more small-size sheets having a width less than that of the heat generating portion of the center heater;

wherein the control unit turns on the edge heater to heat the fusing part when the capacitor stops discharging electricity during a consecutive fusing process of a plurality of the small-size sheets.

2. The fusing device as claimed in claim 1, wherein the control unit sets a target edge temperature of the edge portions of the fusing part at a given temperature, to compare an actual temperature of the edge portions of the fusing part with the target edge temperature, and to control the edge heater based on the comparison result;

wherein when the consecutive fusing process is started, the control unit continuously turns off the edge heater by setting the target edge temperature at a first temperature or by forcibly turning off power to the edge heater; and wherein when the capacitor stops discharging electricity during the consecutive fusing process, the control unit sets the target edge temperature at a second temperature higher than the first temperature and thereby turns on the edge heater to heat the fusing part up to the second temperature.

3. The fusing device as claimed in claim 2, wherein when a discharge voltage of the capacitor falls to a predetermined voltage between a full charge voltage and a discharge stop voltage during the consecutive fusing process, the control unit sets the target edge temperature at a third temperature between the first temperature and the second temperature and thereby turns on the edge heater to heat the fusing part up to the third temperature.

4. A fusing device, comprising:

a fusing part;

a pressing part rotatably pressed against the fusing part to form a fusing nip for fusing a toner image onto a sheet;

a capacitor;

a center heater including a heat generating portion configured to heat a center portion in the width direction of the fusing part;

an edge heater including heat generating portions configured to heat edge portions in the width direction of the fusing part;

an auxiliary heater configured to heat the fusing part; and a control unit to continuously turn off the edge heater and to turn on the center heater and the auxiliary heater to heat the fusing part during a fusing process of a small-size sheet having a width less than that of the heat generating portion of the center heater;

wherein if a charge voltage of the capacitor is lower than a discharge enabling voltage and the auxiliary heater is not turned on when the fusing process of a small size sheet is started, the control unit turns on the center heater and the edge heater to heat the fusing part.

5. An image forming apparatus comprising the fusing device of claim 1.

* * * * *